United States Patent [19]

Lang et al.

[11] 4,444,698

[45] Apr. 24, 1984

[54] SPECIAL HEAT EXCHANGE FOR COAL LIQUEFACTION SYSTEM

[75] Inventors: Udo Lang, Munich; Ullrich Hildebrandt, Pullach; Walter Schramm; Berndt Hoerner, both of Munich, all of Fed. Rep. of Germany

[73] Assignee: Linde Aktiengesellschaft, Wiesbaden, Fed. Rep. of Germany

[21] Appl. No.: 325,936

[22] Filed: Nov. 30, 1981

Related U.S. Application Data

[62] Division of Ser. No. 204,990, Nov. 10, 1980, abandoned.

[30] Foreign Application Priority Data

Nov. 9, 1979 [DE] Fed. Rep. of Germany ..... 2945352

[51] Int. Cl.[3] ..... F02M 31/00

[52] U.S. Cl. ..... 261/157; 261/161

[58] Field of Search ..... 261/157, 161

[56] References Cited

U.S. PATENT DOCUMENTS

| | | | |
|---|---|---|---|
| 1,284,080 | 11/1918 | Fischer | 261/161 |
| 1,562,827 | 11/1925 | Fothergill | 261/161 |
| 1,669,673 | 5/1928 | Price | 261/161 |
| 2,311,512 | 2/1943 | Backstrom et al. | 261/161 |
| 2,414,135 | 1/1947 | Berlowitz | 261/161 |
| 2,689,018 | 9/1954 | Kittredge | 261/161 |
| 3,499,734 | 3/1970 | Newman et al. | 261/161 |

FOREIGN PATENT DOCUMENTS

| | | | |
|---|---|---|---|
| 435587 | 10/1926 | Fed. Rep. of Germany | 261/161 |
| 854225 | 4/1940 | France | 261/161 |
| 27026 | of 1898 | United Kingdom | 261/161 |
| 478090 | 1/1938 | United Kingdom | 261/161 |
| 591057 | 8/1947 | United Kingdom | 261/161 |

*Primary Examiner*—William R. Cline
*Assistant Examiner*—Peggy A. Neils
*Attorney, Agent, or Firm*—Millen & White

[57] ABSTRACT

Apparatus for heating a flowable mixture of particulate coal and a liquid hydrocarbon stream at high pressure by heat exchange with reaction products of a coal hydrogenation and liquefaction process which are obtained in the gaseous phase under reaction conditions, comprising direct heat exchange means and indirect heat exchange means combined into a single structural unit, and being devoid of liquid spray means, said single structural unit containing an upper zone separated from a lower zone and being housed in a pressure vessel, and further comprising feed means for viscous material connected to the bottom part of the housing, said indirect heat-exchange means being equipped with a feed means and a discharge means for a heat exchange fluid, said direct heat-exchange means arranged above said direct heat exchange means and being provided with discharge means for heated viscous material, feed means for heat exchange fluid for said direct heat exchange, and discharge means for the latter heat exchange fluid communicating with said indirect heat-exchange means, thereby resulting in apparatus wherein essentially the same fluid is employed for heat exchange purposes for both the indirect an direct heat exchange means.

8 Claims, 1 Drawing Figure

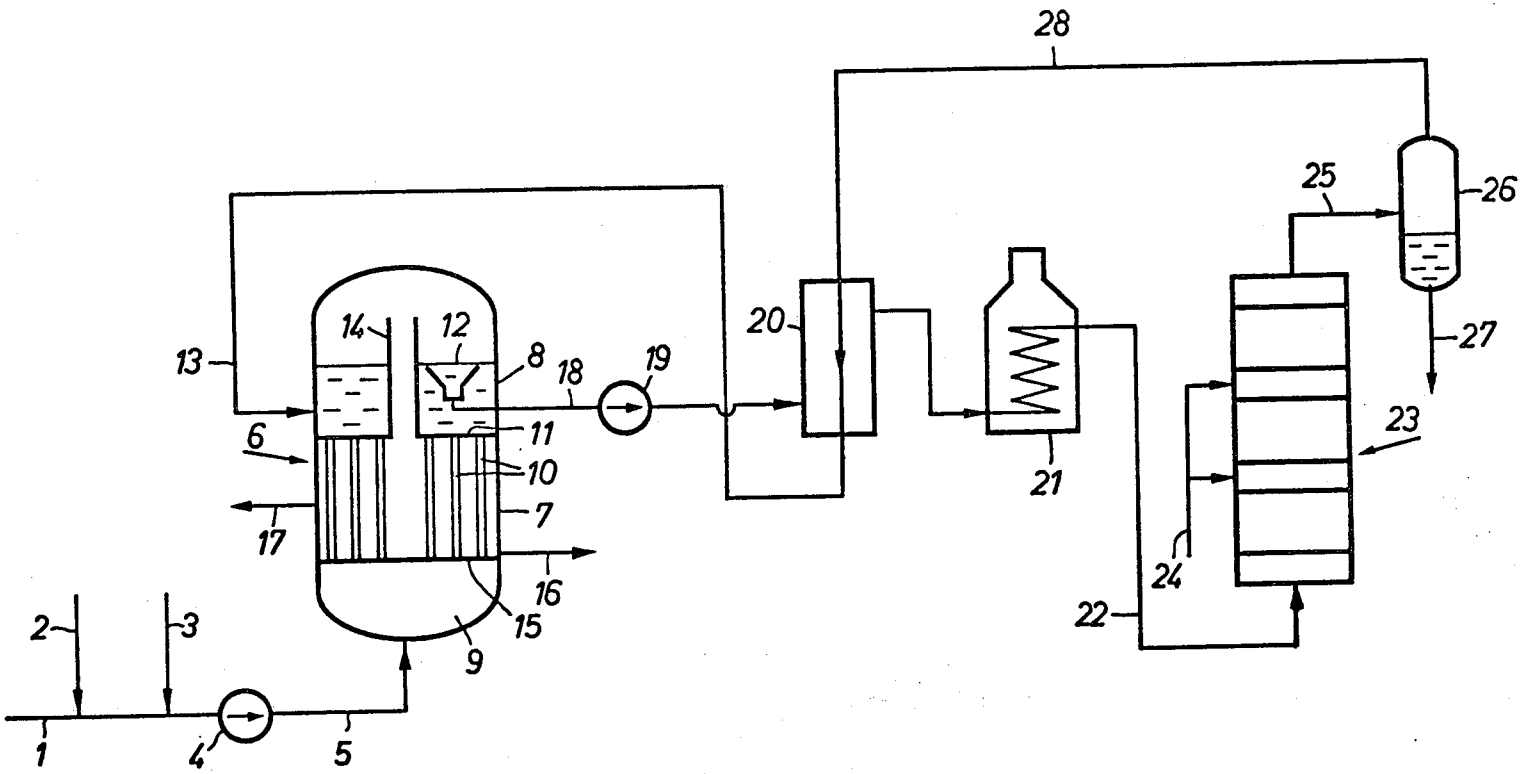
1
2
3
4
5
6
7
8
9
10
11
12
13
14
15
16
17
18
19
20
21
22
23
24
25
26
27
28

SPECIAL HEAT EXCHANGE FOR COAL LIQUEFACTION SYSTEM

This is a division, of application Ser. No. 204,990 filed Nov. 10, 1980, now abandoned.

BACKGROUND OF THE INVENTION

This invention relates in general to the field of heat exchange and heat exchange apparatus, especially where viscous materials must be heated. It finds particular application to coal liquefaction and liquefaction systems especially wherein a flowable mixture of fine particle size coal and a liquid hydrocarbon stream is compressed to a high pressure, heated in several heat-exchange stages to the reaction temperature, and reacted in the presence of hydrogen and a hydrogenation catalyst, with separation of the liquid and gaseous reaction products in a high temperature phase separator, and cooling of the gaseous reaction products by heat exchange with the mixture to be heated, and wherein the mixture is diluted by condensate formed during the cooling step.

Numerous methods have been proposed for obtaining liquid hydrocarbons by coal hydrogenation. In a conventional process, comminuted coal is mixed with particulate catalyst and then blended with a liquid hydrocarbon to obtain a flowable coal-oil paste-like mixture. The mixture is then compressed to a required, high process pressure usually ranging between 150 and 300 bar. During the subsequent heating to the reaction temperature of normally between 400° and 500° C., hydrogenating hydrogen is added to the mixture at a suitable location. Preheating of the compressed mixture is conducted in several heat-exchange stages by indirect heat exchange with gaseous reaction products. To increase the fluidity of the mixture, after at least one preheating step, it is diluted with a condensate obtained during the cooling of the hot, gaseous reaction products. For additional details of such a conventional process, attention is invited to W. Krönig, Die katalytische Druckhydrierung von Kohlen, Teeren und Mineralölen, Springer-Verlag, Berlin/Göttingen/Heidelberg, 1950.

One disadvantage of this conventional process is the fact that the preheating of the mixture is associated with a considerable pressure loss through the heat exchangers due primarily to the high viscosity of the mixture. This pressure loss is usually about 20 bar; thus increased work is necessitated to maintain the required pressure in the reactor.

SUMMARY OF THE INVENTION

Objects of this invention are to provide an improved heat exchange process and apparatus.

A particular object is to provide, in coal liquefaction, a process of the type mentioned above with improvements resulting in a reduction of the pressure loss during the preheating step.

Upon further study of the specification and appended claims, further objects and advantages of this invention will become apparent to those skilled in the art.

Using the coal liquefaction process as an example, the objects of this invention are attained by cooling the gaseous reaction products in at least one heat-exchange stage by direct heat exchange with the mixture.

The direct heat exchange between the gaseous reaction products and the mixture to be heated, as proposed according to the invention, can take place, for example, in a simple pressure vessel by bringing the gaseous reaction products in an upwardly directed stream in contact with downwardly flowing mixture fed to the upper zone, or also simply by introducing the gaseous reaction products directly into the coal-oil slurry whereby the reaction products are cooled while rising to the surface. Since the relatively small flow cross sections, e.g., pipes or tubes for the mixture to be heated, required in case of indirect heat exchange, are thus eliminated or at least reduced, a pressure less which is substantially less than the case of conventional processes is thus obtained. Moreover, the process of this invention is also simpler construction-wise than the conventional process, since a direct heat exchanger represents a substantially simpler and thus less expensive part of the plant than an indirect heat exchanger having separate flow cross sections for the heat-exchanging media. Another advantage stems from the fact that the condensate produced during cooling of the gaseous reaction products remains automatically in the mixture in case of direct heat exchange and contributes to its dilution and fluidity. Accordingly, it is possible to eliminate the usually required separator for condensate separation subsequent to cooling of the gas, and to omit the step of reintroducing the condensate into the mixture.

In an advantageous embodiment of the process according to the invention, a direct heat-exchange stage is arranged between two indirect heat-exchange stages so that the cold mixture is warmed first by indirect heat exchange, then by direct heat exchange, and finally again by indirect heat exchange against the gaseous reaction products. This mode of operation is advantageous, in particular, if it is intended to obtain from the gaseous reaction products a relatively low boiling condensate as the partial product which boils at a relatively low temperature and is obtained in the last indirect heat exchanger.

Another advantageous method for performing the process encompasses merely a two-stage heat exchange wherein initially an indirect heat exchange and subsequently a direct heat exchange are performed between the gaseous reaction products and the mixture to be heated. In this case, direct heat exchange will be conducted down to temperatures lower than the case of a subsequent third, indirect heat exchanger. For this reason, the condensate obtained at lower temperatures during indirect heat exchange remains likewise in the mixture as a diluent. However, it has been found that the amount of heat contained in the gaseous reaction products is so large that the uncondensed components can be withdrawn from the direct heat exchanger at a relatively high temperature, so that during the further cooling of these components against other media, e.g. in the context of steam generation plants, a large portion of the valuable, relatively low-boiling components can still be obtained, which are also producted in the indirect heat-exchange section during the three-stage mode of operation.

The preheating of the mixture according to the invention is preferably conducted in apparatus comprising a structural unit containing both direct heat-exchange means and indirect heat-exchange means. This unit proves to be especially advantageous in cases wherein direct heat exchange takes place between two indirect heat-exchange stages. For it is found in this instance that, as compared with conventional processes with three indirect heat-exchange stages, the heat-exchange surface in the remaining two indirect heat exchangers can be considerably reduced, since the direct heat exchange in the central heat exchanger is particularly effective. The pressure losses in the preheating stage thus are reduced not only by the use of the direct heat exchanger exhibiting a low flow resistance, but moreover are also decreased by the utilization of smaller indirect heat exchangers.

The combination of a direct heat exchange means and indirect heat exchanger means into a structural unit proves to be advantageous, because the two heat exchangers can then be accommodated in a single pressure vessel designed for the high process pressure. The expenditure for additional pressure-proof containers is thereby lowered.

In a preferred construction of the device according to this invention, the high-pressure container contains in the lower zone an indirect heat-exchange section and thereabove a direct heat-exchange section wherein the direct heat-exchange section is operated at a higher temperature than the indirect heat-exchange section. The flow of the mixture to be heated is from the bottom toward the top of the apparatus, whereas the gaseous reaction products to be cooled are first introduced into the upper, direct heat-exchange section and thereafter pass down through the indirect heat-exchange section. In this connection, the indirect heat-exchange section advantageously comprises a tubular heat exchanger having straight tubes, because this constitutes a simple construction as well as relatively low flow resistance.

The cooling of the gaseous reaction products in the indirect heat-exchange section is accompanied by a condensate formation of those components boiling within the temperature range at which the indirect heat-exchange section is operated. This condensate which, depending on the design of the plant, can be a desired process product must be separated from the reaction products which have remained in the gaseous phase and is optionally passed on to further processing. The separation of the condensate can, in an advantageous further development of the device of this invention, be integrated into the indirect heat-exchange section. This is attained by providing the indirect heat-exchange section with two discharge conduits, one of which is arranged in the lower zone and removes the condensate collected at that location, while the other discharge conduit is provided for the gas at a location above the condensate liquid level. This construction makes it possible to eliminate a separate phase separator.

It is furthermore advantageous to arrange the direct heat-exchange section immediately above the indirect heat-exchange section, so that the entire zone of the pressure vessel lying above the indirect heat-exchange section represents the direct heat-exchange section. The mixture preheated in the indirect heat-exchange section, preferably in the straight tubes of this section, fills the lower zone of the direct heat-exchange section and is at that location brought into contact with the gaseous reaction products. To attain intensive heat exchange, it is advantageous to arrange the feed conduit for the gaseous reaction products in such a way that these products are directly introduced into the mixture, so that the products flow through the mixture from the bottom toward the top. For this purpose, the feed conduit is disposed in the lower zone of the direct heat-exchange section.

The components of the gaseous reaction products condensing during cooling in this section remain directly in the mixture and contribute toward the dilution of the latter. The uncondensed components are collected in the upper zone of the direct heat-exchange section and are conducted from there through conduit means into the indirect heat-exchange section for further cooling. A tubular duct, for example a central pipe, is particularly suitable for this purpose, this duct connecting the upper zone of the direct heat-exchange section with the indirect heat-exchange section and extending within the storage tank. The gaseous components thus are conducted through the mixture back into the lower section of the apparatus without the need for a bypass conduit extending from the upper region of the pressure vessel and terminating in the lower zone thereof.

BRIEF DESCRIPTION OF THE DRAWING

The drawing is a schematic illustration of a preferred embodiment of the invention as it can be used in a coal liquefaction system.

DETAILED DESCRIPTION OF THE DRAWING

In the process scheme illustrated, the reactants, catalysts and operating conditions are essentially conventional except for the special heat exchange technique and apparatus of the invention. Comminuted coal is introduced via conduit 1 and mixed with catalyst feed via conduit 2. Subsequently, the coal-catalyst mixture, having a temperature of about 60° C., is processed into a pumpable mixture with diluting oil having a temperature of 250° C. and obtained from conduit 3. The diluting oil is customarily a high-boiling fraction separated from the reaction products. The mixture is thereupon compressed in pump 4 to a pressure of about 230 bar and then passes via conduit 5 into a two-stage heat exchanger 6 comprising an indirect heat-exchange section 7 and a direct heat-exchange section 8. The mixture initially enters an antechamber or header 9 in the lower portion of the heat exchanger 6 and is propelled from there via the tubes 10 of the indirect heat-exchange section 7 upwardly into the direct heat-exchange section 8; during this step, the mixture is heated to about 240°–280° C., for example to 260° C.

The direct heat-exchange section 8 beginning immediately above the upper tubesheet 11 of the indirect heat-exchange section 7 is filled in its lower zone with mixture exiting from the pipes 10 and rising up to a level 12. Gaseous reaction products are introduced via conduit 13 into this mixture at such a pressure that entrance of the mixture into conduit 13 is prevented. The hot gaseous reaction products enter into direct heat exchange with the mixture; thereby, high-boiling components are condensed and remain in the mixture as diluents. The lower-boiling components, in contrast thereto, remain in the gas phase. They exit from the mixture at surface 12 and are conducted via the central pipe 14, which is open at the top and passes through the mixture, into the indirect heat-exchange section 7. In the latter, these components are cooled further on the tubes 10 against the mixture to be heated. During this step, additional components are condensed which collect on the lower tubesheet 15 and are withdrawn as product stream via conduit 16. The components still remaining in the gas phase even in this heat-exchange section are withdrawn via conduit 17, the latter being arranged at a level above the level of the condensate in the lower zone of this heat-exchange section. The fractions withdrawn via conduits 16 and 17 exhibit a temperature of about 190° C. and can be processed in the usual way to desired products of the process.

The mixture, preheated in the direct heat-exchange section 8 to about 350° C., is withdrawn via conduit 18 and compressed in pump 19 to the required process pressure of about 250 bar. Subsequently, the mixture is heated in the indirect heat exchanger 20° to 406° C. and thereupon heated further to the reaction temperature of 430° C. in a preheater 21 heated by external energy. The mixture thereafter enters the reactor 23 via conduit 22, wherein it is rapidly heated further due to the exothermic reaction. To limit the reaction temperature, cold gas fed via conduit 24 is introduced at suitable locations so that the temperature in the reactor does not rise above about 470° C. The cold gas is, for example, a gas enriched with hydrogen and methane, which is separated during the working up of the product gases obtained in conduit 17.

The reaction products are withdrawn via conduit 25 and first separated into a gaseous phase and a liquid phase in a high temperature phase separator 26. The liquid phase, also carrying the catalyst entrained with the mixture, is discharged via conduit 27 and worked up as usual. The gaseous reaction products are withdrawn via conduit 28 and enter the indirect heat exchanger 20 at a temperature of about 430° C.; in heat exchanger 20, they are cooled to about 380° C. Condensate obtained at this temperature remains in the stream, so that a two-phase mixture is fed via conduit 13 into the heat exchanger 6. The pressure drop occurring during the heating of the mixture is about 10 bar which is only about half as large as in the ususal processes with preheating effected by indirect heat exchange alone.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Apparatus for heating a flowable mixture of particulate coal and a liquid hydrocarbon stream at high pressure by heat exchange with reaction products of a coal hydrogenation and liquefaction process which are obtained in the gaseous phase under reaction conditions, comprising direct heat exchange means and indirect heat exchange means combined into a single structural unit, and being devoid of liquid spray means, said single structural unit containing an upper zone separated from a lower zone, said unit being housed in a pressure vessel, and further comprising feed means for viscous material, said feed means comprising a header at the bottom part of the housing and being in communication with said indirect heat exchange means, said indirect heat-exchange means being equipped with a feed means and a discharge means for a heat exchange fluid, said direct heat-exchange means arranged above said indirect heat exchange means and being provided with discharge means for heated viscous material, feed means for heat exchange fluid for said direct heat exchange, and discharge means for the latter heat exchange fluid communicating with said indirect heat-exchange means, thereby resulting in apparatus wherein essentially the same fluids are employed for heat exchange purposes for both the indirect and direct heat exchange means.

2. Apparatus according to claim 1, said indirect heat-exchange means comprising a tubular heat exchanger with straight tubes.

3. Apparatus according to claim 1, said discharge means for heat exchange fluid from the indirect heat-exchange means comprising a condensate conduit arranged in the lower zone of the indirect heat-exchange means and a gas conduit located above the condensate conduit.

4. Apparatus according to claim 1, said direct heat-exchange means being located immediately above the indirect heat-exchange means and comprising the upper zone of the pressure vessel.

5. Apparatus according to claim 1, wherein said feed means for heat exchange fluid is arranged in the lower zone of the direct heat-exchange means.

6. Apparatus according to claim 1, wherein the discharge means for heat exchange fluid from the direct heat-exchange means and communicating with the indirect heat-exchange means comprises a conduit communicating with said indirect heat-exchange section and terminating in the upper zone of the direct heat-exchange means above liquid contained in said upper zone, and liquid level controlling means housed within said upper zone.

7. Apparatus according to claim 6, said discharge means for heat exchange fluid from the indirect heat-exchange means comprising a condensate conduit arranged in the lower zone of the indirect heat-exchange means and a gas conduit located above the condensate conduit.

8. Apparatus according to claim 6, wherein said conduit communicating with said indirect heat-exchange section is a central conduit.

* * * * *